US007604186B2

(12) United States Patent
Sawada et al.

(10) Patent No.: US 7,604,186 B2
(45) **Date of Patent: *Oct. 20, 2009**

(54) PROCESS FOR PREPARING GROUND RESIN PARTICLES AND APPARATUS FOR PREPARING THE SAME

(75) Inventors: Yasuhiko Sawada, Settsu (JP); Toshinari Tanaka, Settsu (JP); Kazuhiko Shimada, Settsu (JP); Kazuhiro Mishima, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 30 days.

This patent is subject to a terminal disclaimer.

(21) Appl. No.: 11/790,120

(22) Filed: Apr. 24, 2007

(65) Prior Publication Data

US 2007/0200015 A1 Aug. 30, 2007

Related U.S. Application Data

(62) Division of application No. 10/297,094, filed as application No. PCT/JP01/04542 on May 30, 2001, now Pat. No. 7,237,732.

(30) Foreign Application Priority Data

Jun. 1, 2000 (JP) ..... 2000-165035
Oct. 19, 2000 (JP) ..... 2000-319668

(51) Int. Cl.
*B02C 19/00* (2006.01)
*B02C 1/00* (2006.01)
*B02C 23/18* (2006.01)

(52) U.S. Cl. ..... 241/1; 241/15

(58) Field of Classification Search ..... 241/1, 241/5, 15, 38, 39

See application file for complete search history.

(56) References Cited

U.S. PATENT DOCUMENTS 5,716,751 A * 2/1998 Bertrand et al. ..... 430/137.18
6,007,958 A 12/1999 Ito et al.
6,074,741 A 6/2000 Murata et al.
6,137,977 A 10/2000 Okado et al.
6,861,467 B2 3/2005 Nakano

FOREIGN PATENT DOCUMENTS

JP 62-164943 10/1987
JP 10-309529 11/1998

* cited by examiner

*Primary Examiner*—Bena Miller
(74) *Attorney, Agent, or Firm*—Sughrue Mion, PLLC

(57) ABSTRACT

A process for preparing ground resin particles is provided by modifying a jet mill with opposed fluidized bed. By using a jet mill having a plurality of jet nozzles disposed at predetermined positions in a barrel of a grinding chamber toward the injection point of the grinding chamber and a bottom wall having a flat surface in part or in whole, parallel to the jet nozzles, or having a conical projection immediately below the injection point, resin particles to be ground are jetted with or without water, thereby being ground to obtain ground resin particles of an intended particle size.

7 Claims, 7 Drawing Sheets

PROCESS FOR PREPARING GROUND RESIN PARTICLES AND APPARATUS FOR PREPARING THE SAME

CROSS-REFERENCE TO RELATED APPLICATION

This application is a divisional of U.S. application Ser. No. 10/297,094 which is a 371 of PCT International application Ser. No. PCT/JP01/04542 filed May 30, 2001, the above-noted applications incorporated herein by reference in their entirety.

TECHNICAL FIELD

The present invention relates to a process for preparing resin particles by using a jet mill. According to the present invention, resin particles difficult to produce efficiently into uniform ground particles, such as fluorine resin particles, polytetrafluoroethylene (PTFE) particles in particular, can be ground into uniform particles in an efficient manner. The present invention also relates to a process in which cooling is not carried out in the grinding step, thereby achieving the reduction of production costs. Further, the present invention relates to a jet mill suitable for such process.

BACKGROUND ART

Various methods are known as a grinding method of resin particles, particularly, fluorine resin particles. Among them, the impact grinding method with a pneumatic classifier is widely employed since the method is economically efficient in preparing resin particles of a relatively large size. However, when fluorine resin particles are ground according to the impact grinding method, the obtained ground particles have small apparent density, become fibrous and have inferior properties owing to the heat generation during the grinding process. Alternatively, jet grinding methods have been attempted to improve the properties of the ground particles, which comprises jetting compressed air toward the central axis of the grinding chamber through three opposed jet nozzles provided in the grinding chamber while resin particles to be ground are fluidized and continuously supplied from the top or bottom of the grinding chamber, thereby colliding the resin particles with each other to grind them (JP-A-63-194750, JP-A-64-4401, JP-A-4-271853, JP-A-6-254427 and JP-A-7-275731).

However, when fluorine resin particles or other types of resin particles are ground according to the grinding method using a conventional jet mill, the ground resin particles or non-classified coarse resin particles tend to become adhesive and agglomerate. The fallen particles sometimes remain in a bulk at the bottom of the grinding chamber, resulting in the reduction of grinding ability (amount of collected resin particles of an intended particle size). In this way, conventional jet mills have a disadvantage that the grinding ability is extremely low when compared with the impact grinding method.

In addition, when the temperature of the resin particles to be ground, the compressed air or the jet mill is high, the resin particles tend to have large elasticity and the grinding of the particles becomes difficult, resulting in the lowering of the grinding efficiency. Under such circumstances, various attempts have been made. For example, the resin particles to be ground are cooled, a cooling jacket is provided on the jet mill, and the compressed air for jetting is cooled beforehand.

Thus, a lot of attention has been paid when resin particles are ground by using a jet mill.

In view of the above problems, the present inventors have conducted intensive studies and found a novel process for preparing uniform resin particles efficiently by using a jet mill, and completed the present invention.

An object of the present invention is to provide a process for preparing ground resin particles by modifying a jet mill with opposed fluidized bed to increase the grinding efficiency dramatically, thereby making operating conditions less tight and achieving a smaller device size and reduced running costs.

Another object of the present invention is to provide a novel jet mill suitable for the process of the present invention.

DISCLOSURE OF INVENTION

That is, the first process of the present invention is a process for preparing ground resin particles by using a jet mill having a plurality of jet nozzles disposed at predetermined positions in a barrel of a grinding chamber toward the injection point located in the grinding chamber and a bottom wall having a flat surface in part or in whole parallel to the jet nozzles (hereinafter referred to as "jet mill A"), or a jet mill having a plurality of jet nozzles disposed at predetermined positions in a barrel of a grinding chamber toward the injection point located in the grinding chamber and a bottom wall having a conical projection immediately below the injection point (hereinafter referred to as "jet mill B"); the process comprising steps of: jetting compressed air toward the central axis of the grinding chamber through the jet nozzles disposed in the grinding chamber, while resin particles to be ground are fluidized and continuously supplied from the top or the bottom of the grinding chamber, thereby colliding the resin particles to be ground with each other to grind the resin particles; and collecting ground resin particles having an intended particle size (hereinafter referred to as "first process").

The second process of the present invention is a process for preparing ground resin particles by using a jet mill having a plurality of jet nozzles disposed at predetermined positions in a barrel of a grinding chamber toward the injection point located in the grinding chamber, the process comprising steps of: jetting compressed air toward the central axis of the grinding chamber through the jet nozzles disposed in the grinding chamber, while resin particles to be ground are fluidized and continuously supplied from the top or the bottom of the grinding chamber, thereby colliding the resin particles to be ground with each other to grind the resin particles; and collecting ground resin particles of an intended particle size, wherein the resin particles to be ground are associated with water (hereinafter referred to as "second process").

In the second process, the temperature inside the jet mill and/or the compressed air to be jetted is preferably 0° to 50° C. The object of the present invention can be achieved even if the jet mill and/or the compressed air to be jetted are not cooled or even if resin particles which are not dried after polymerization are used as the water-associated resin particles to be ground. It is also possible to add water to resin particles to be ground after drying.

The amount of water is preferably 0.5 to 30 parts by weight, more preferably 1 to 15 parts by weight, most preferably 3 to 10 parts by weight based on 100 parts by weight of the resin particles to be ground.

In the second process, conventional jet mills may be used, but it is preferable to use the jet mill A or the jet mill B.

As for the resin particles to be ground, at least one kind of resin particles is used, and a particularly excellent effect can be obtained when at least one kind of resin particles is fluorine resin particles.

It is preferable that the tip of each jet nozzle is positioned so that the diameter of a circle contouring the tips of the jet nozzles is about 0.5 to 1.0 times the inner diameter of the barrel of the grinding chamber in the jet mill A and the jet mill B.

In the jet mill A, the height from the injection point to the flat surface is preferably about 0.1 to 0.4 times the diameter of a circle contouring the tips of the jet nozzles.

With respect to the flat surface of the bottom wall, the flat surface may be the bottom wall itself (hereinafter referred to as jet mill A1) or the top face of a frustum provided on the bottom wall (hereinafter referred to as jet mill A2).

In the jet mill B, it is preferable that the height of the conical projection is adjusted to about 0.2 to 0.9 times the distance between the injection point and the bottom wall, and the apex angle of the conical projection is adjusted to about 30 to 150 degrees.

The present invention also relates to the jet mill A1, the jet mill A2 and the jet mill B.

That is, the present invention relates to jet mill A1 having a plurality of jet nozzles disposed at predetermined positions in a barrel of a grinding chamber toward the injection point located in the grinding chamber, wherein the bottom wall of the grinding chamber has a flat surface parallel to the jet nozzles, and the diameter of a circle contouring the tips of the jet nozzles is about 0.5 to 1.0 times the inner diameter of the barrel of the grinding chamber; jet mill A2 having a plurality of jet nozzles disposed at predetermined positions in a barrel of a grinding chamber toward the injection point located in the grinding chamber, wherein a frustum projection is provided on the bottom wall of the grinding chamber, and the diameter of a circle contouring the tips of the jet nozzles is about 0.5 to 1.0 times the inner diameter of the barrel of the grinding chamber; and jet mill B having a plurality of jet nozzles disposed at predetermined positions in a barrel of a grinding chamber toward the injection point located in the grinding chamber, wherein a conical projection is provided on the bottom wall of the grinding chamber, and the diameter of a circle contouring the tips of the jet nozzles is about 0.5 to 1.0 times the inner diameter of the barrel of the grinding chamber.

BEST MODE FOR CARRYING OUT THE INVENTION

First, the novel jet mill which may be used in the present invention is explained with reference to the attached drawings.

Figure 1:
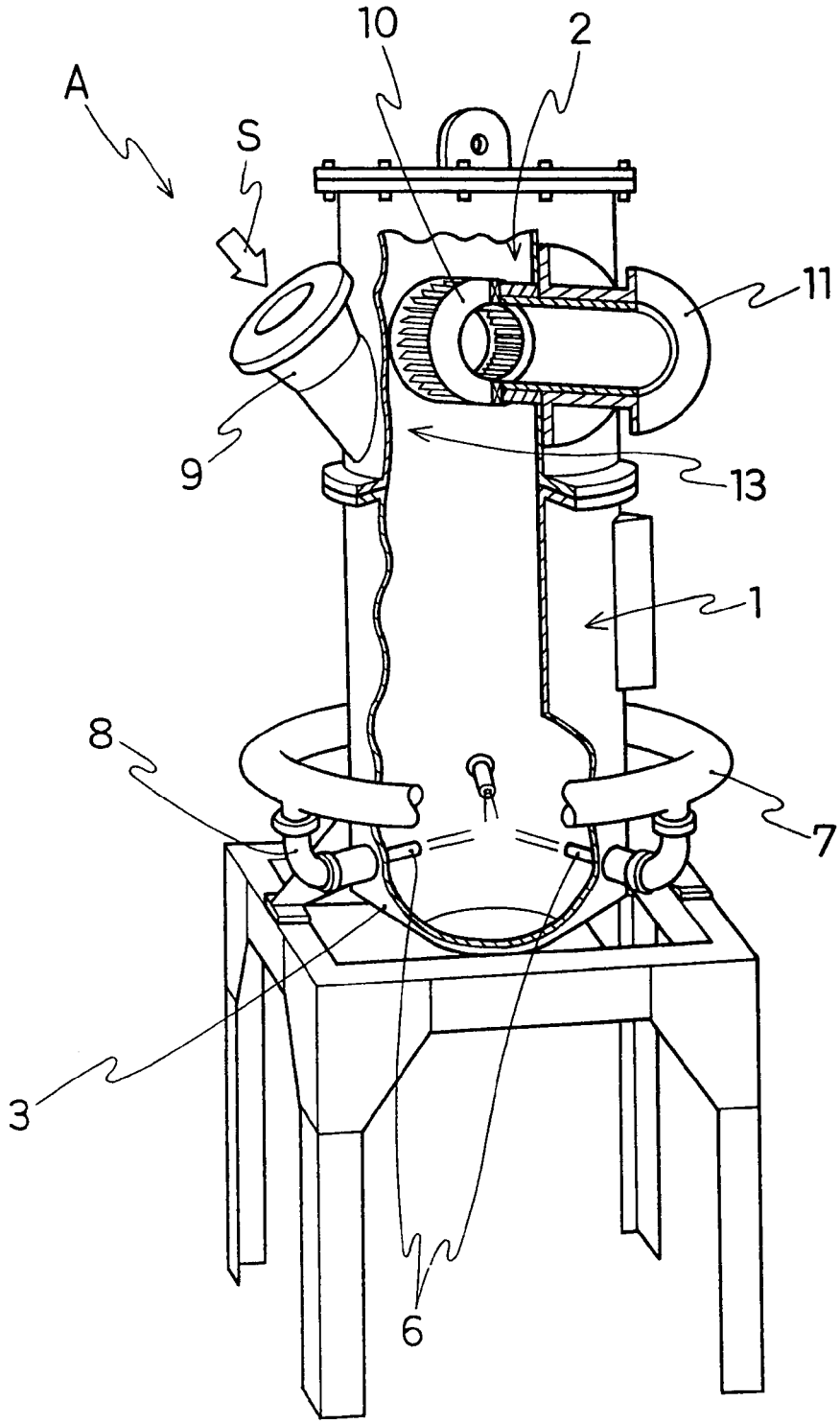
FIG. 1 is a partially cutaway perspective view illustrating an embodiment of the jet mill (A1) which can be used for the process of the present invention.
Figure 2:
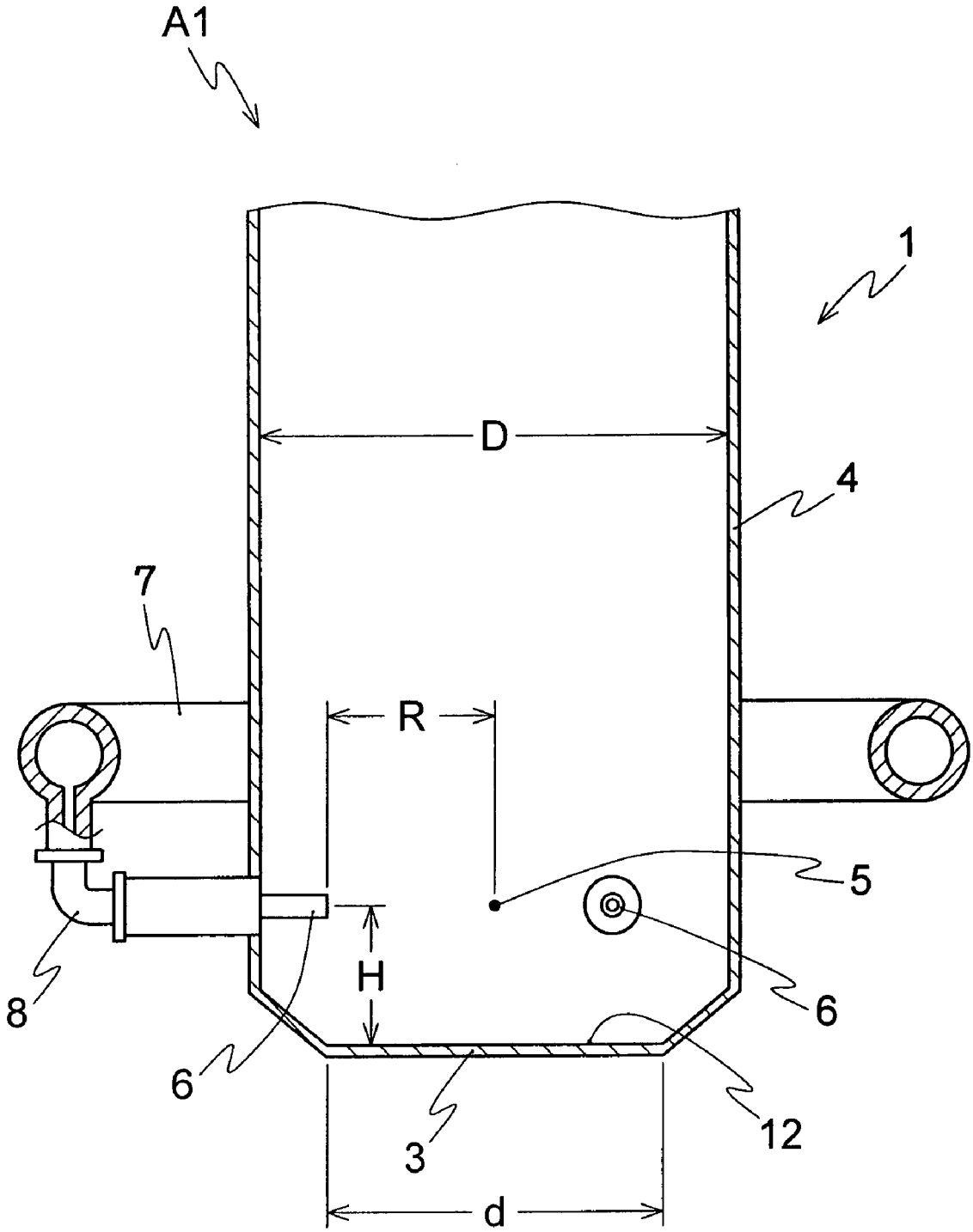
FIG. 2 is a longitudinal cross-sectional view illustrating a substantial part of the jet mill A1 shown in FIG. 1.
Figure 3:
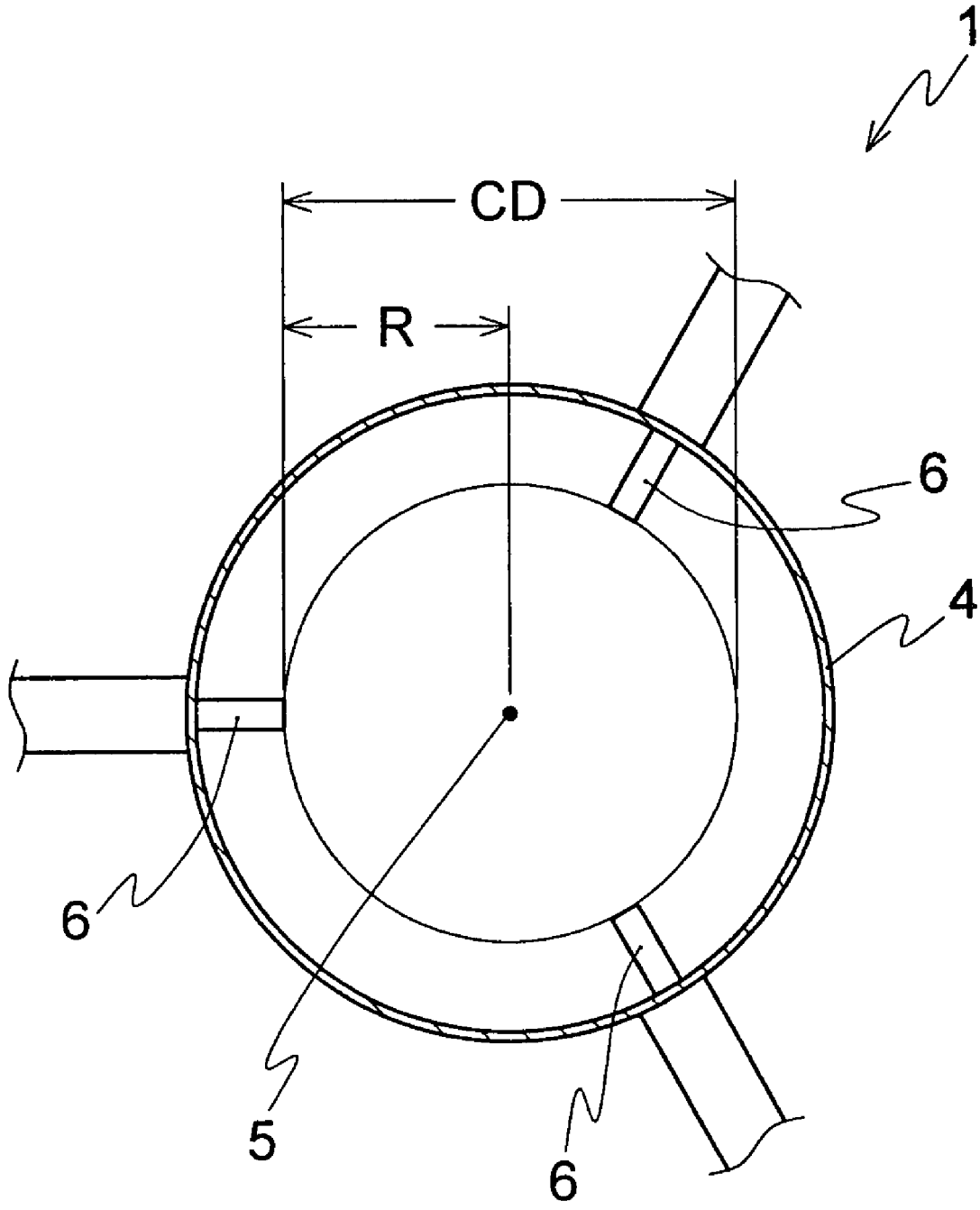
FIG. 3 is a horizontal cross-sectional view illustrating a substantial part of the jet mill A1 shown in FIG. 1.
Figure 4:
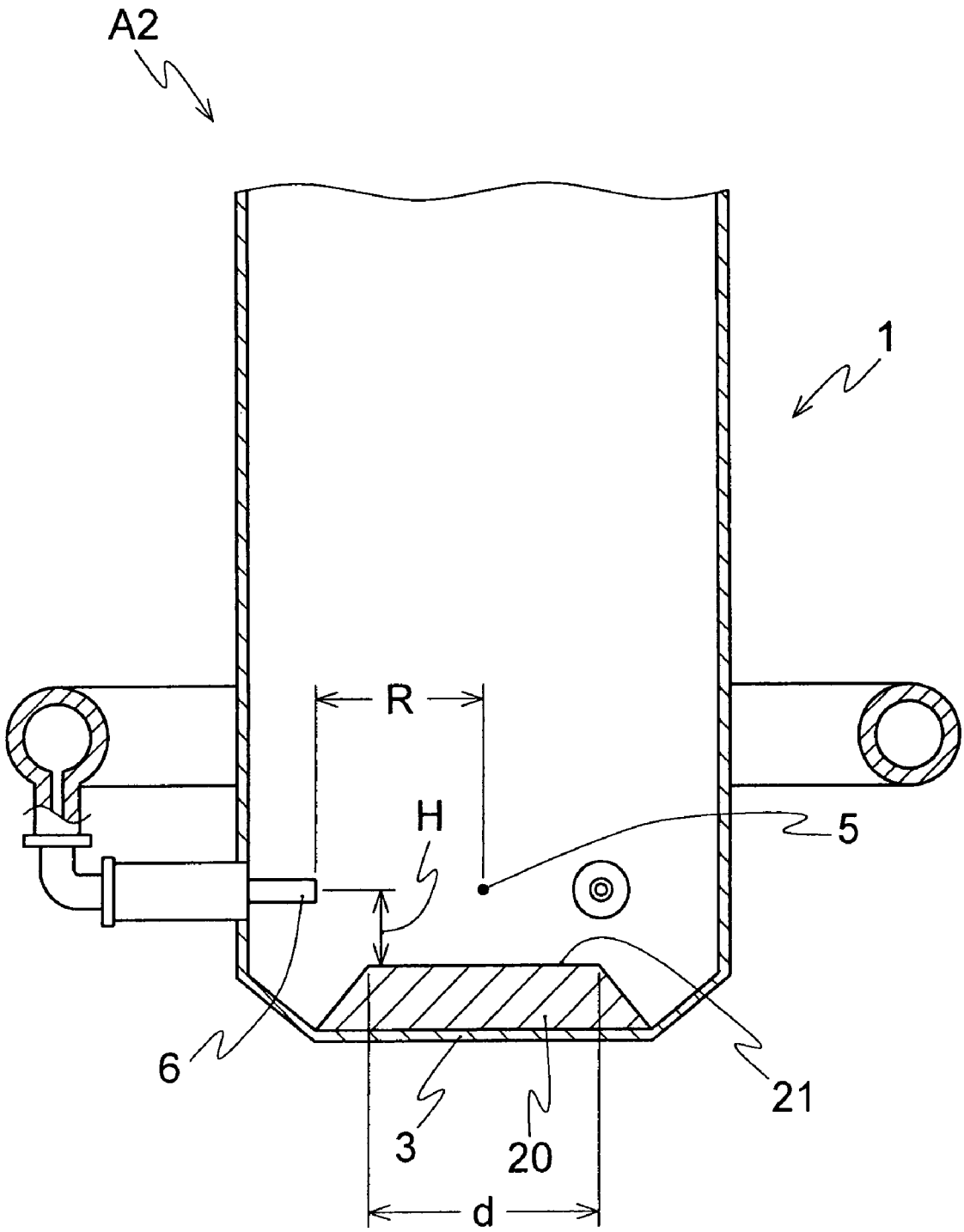
FIG. 4 is a longitudinal cross-sectional view illustrating a substantial part of an embodiment of the jet mill (A2) which can be used for the process of the present invention.
Figure 5:
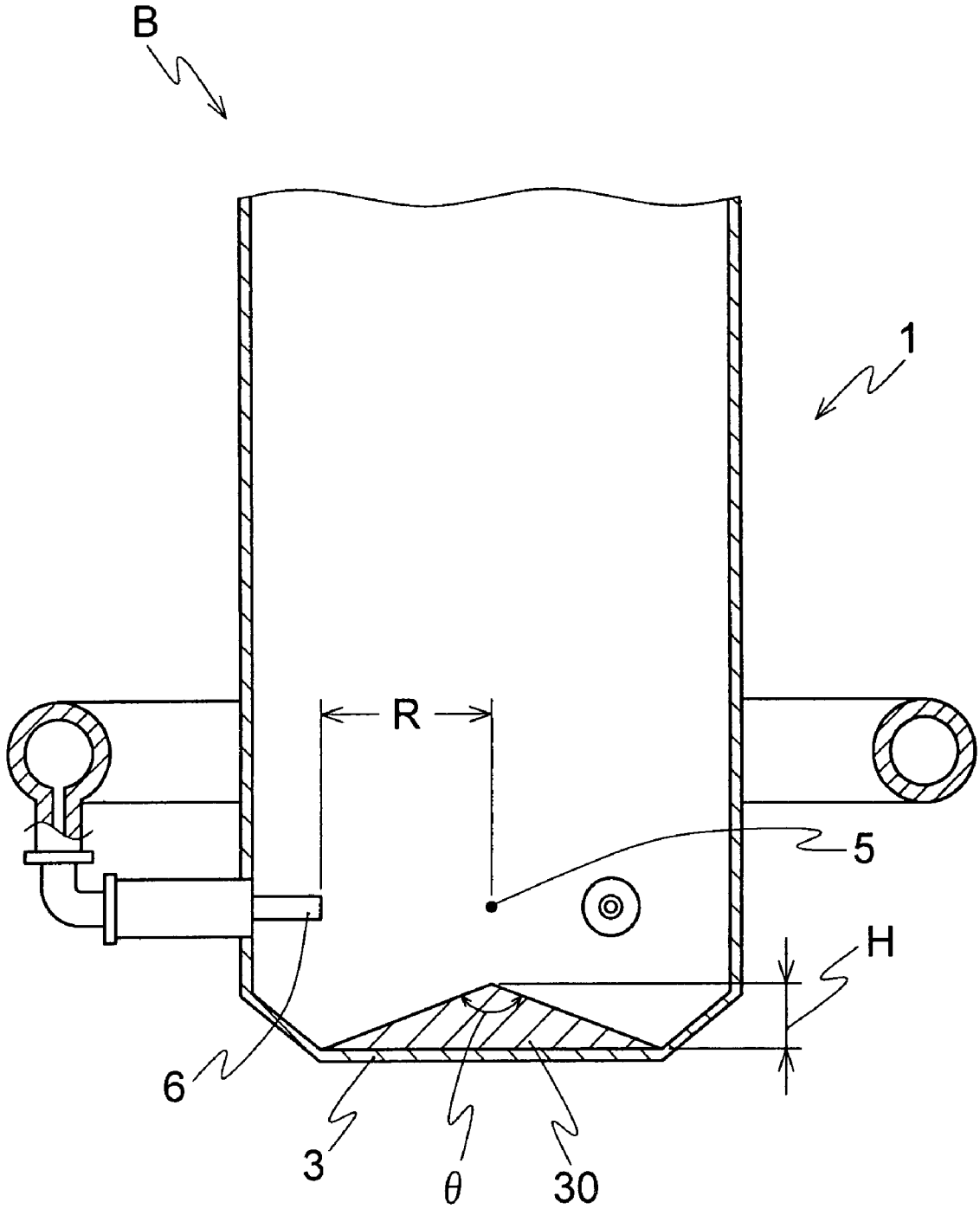
FIG. 5 is a longitudinal cross-sectional view illustrating a substantial part of an embodiment of the jet mill (B) which can be used for the process of the present invention.
Figure 6:
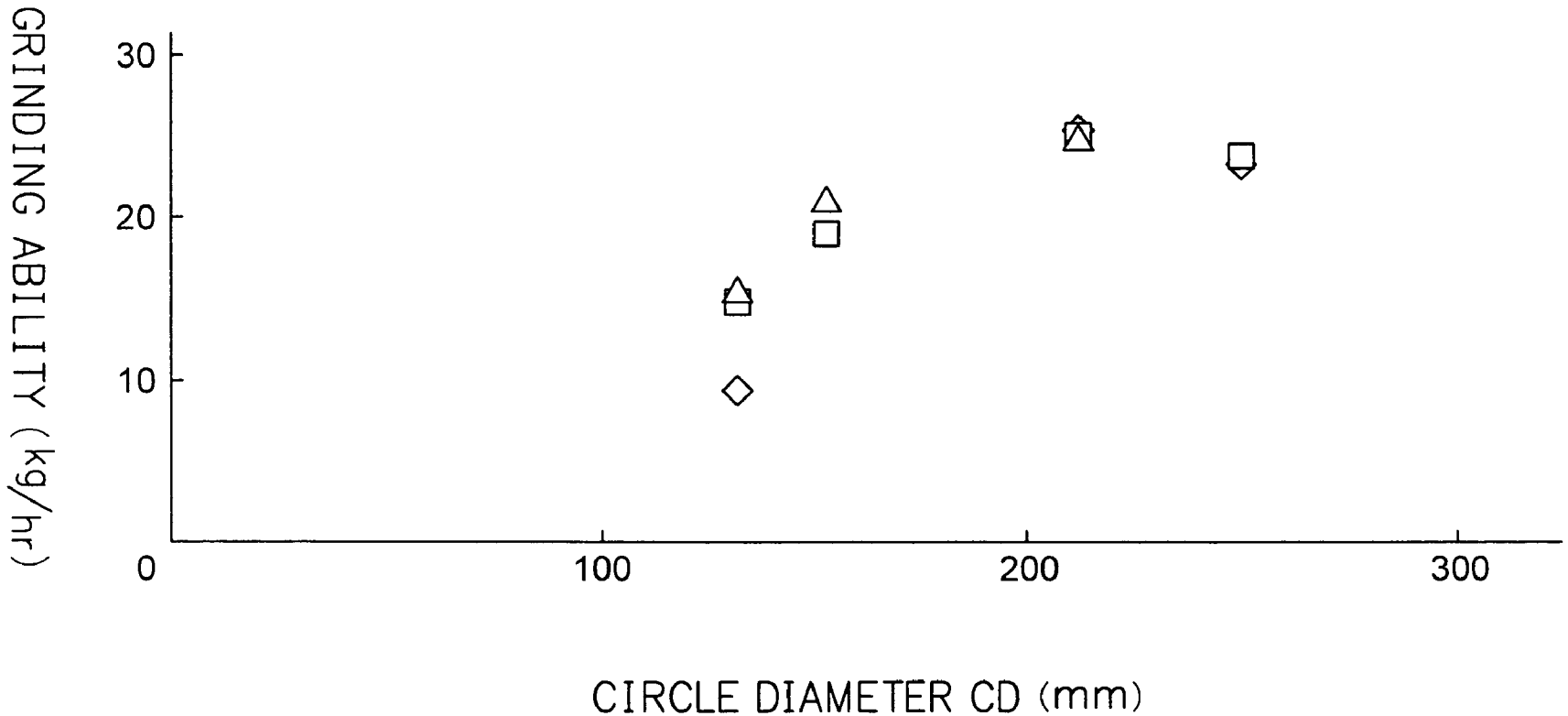
FIG. 6 is a graph showing a relationship between the diameter of a circle contouring the jet nozzles and the height of the injection point, which relates to the grinding ability, regarding Examples 1 to 4.
Figure 7:
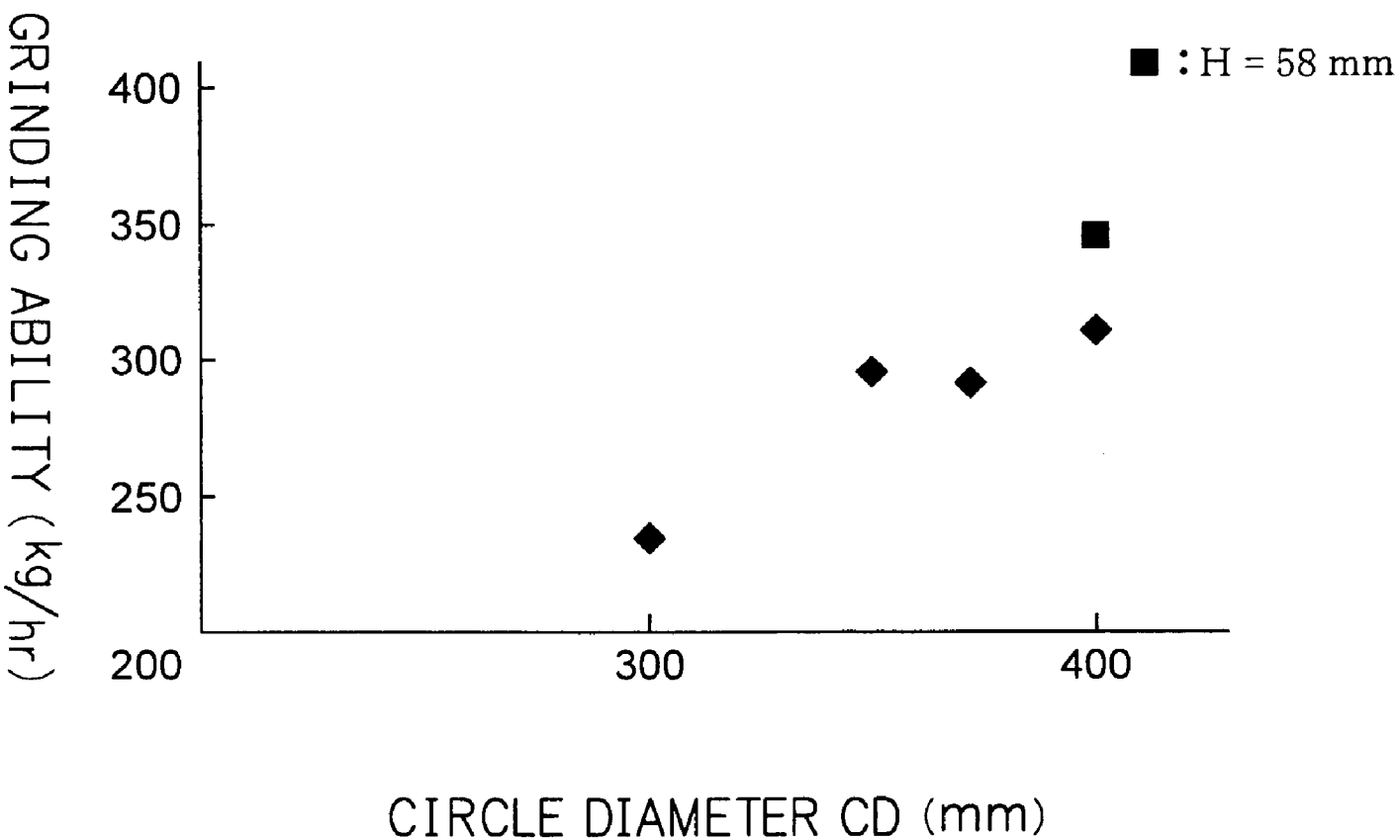
FIG. 7 is a graph showing a relationship between the diameter of a circle contouring the jet nozzles and the height of the injection point, which relates to the grinding ability, regarding Examples 5 to 9.

FIG. 1 is a partially cutaway perspective view illustrating an embodiment of the jet mill A1; FIG. 2 is a longitudinal cross-sectional view of a substantial part of the jet mill A1 shown in FIG. 1; FIG. 3 is a horizontal cross-sectional view of a substantial part of the jet mill A1 shown in FIG. 1; FIG. 4 is a longitudinal cross-sectional view of a substantial part of an embodiment of the jet mill (A2); FIG. 5 is a longitudinal cross-sectional view of a substantial part of an embodiment of the jet mill (B); FIG. 6 is a graph showing a relationship between the distance and the height of jet nozzles, which relates to the grinding ability, regarding Examples 1 to 4: and FIG. 7 is a graph showing a relationship between the distance and the height of jet nozzles, which relates to the grinding ability, regarding Examples 5 to 9 mentioned later.

As shown in FIGS. 1 to 3, the jet mill A1 of the present invention comprises a cylindrical grinding chamber 1; a means for supplying the resin particles to be ground, which is provided on the top of the grinding chamber 1; a means 2 for classifying the ground resin particles, which is provided on the upper area of the grinding chamber 1; three jet nozzles 6 disposed at a predetermined positions toward the injection point 5 of the chamber (a point on the central axis of the grinding chamber) along the barrel 4 from the bottom wall 3 of the grinding chamber 1; a means for generating compressed air; an air manifold 7 and a pipe 8 which transfer the generated compressed air to the jet nozzle 6; and a powder cyclone in which classified powder products are stored. As the means for supplying the resin particles, a hopper or the like can be used. The supplying means is connected to the grinding chamber through the supplying pipe 9. As the classifying means, those having a classifying rotor 10 and a rotation motor can be used. The classifier rotor 10 is connected to the powder cyclone through an exhaust pipe 11.

In the jet mill A1, all or some part of the bottom wall 3 of the grinding chamber is flat so that a flat surface 12 parallel to the jet nozzle 6 is provided in the chamber.

When the value of twice the distance R (from the tip of the jet nozzle to the injection point 5 of the grinding chamber 1), which corresponds to the diameter CD of a circle contouring the tips of the jet nozzles (hereinafter referred to as "circle diameter") is small, colliding space (grinding area) formed around the injection point 5 becomes narrow, in the case of grinding a resin particles having a large specific gravity such as fluorine resin particles. When the circle diameter CD of the jet nozzles 6 is large, the grinding area formed around the injection point 5 is extended, the impact of resin particles to be ground is lowered, and thus the grinding efficiency is decreased. Therefore, the circle diameter CD of the jet nozzles 6 is adjusted to a predetermined distance i.e., about 0.5 to 1.0 times, preferably about 0.7 to 1.0 times, more preferably about 0.85 to 0.95 times the inner diameter D of the barrel, to achieve excellent grinding efficiency.

When the flat surface 12 is close to the grinding area formed around the injection point, the grinding area is narrowed excessively, thereby lowering the grinding efficiency. On the other hand, when the flat surface 12 is away from the grinding area formed around the injection point, the ground resin particles cover the flat surface 12 and serves as a cushioning material to reduce the flowability, and thus the grinding efficiency is lowered. Therefore, it is preferable to adjust height H from the injection point 5 to the flat face 12 to about 0.1 to 0.4, particularly about 0.1 to 0.3 times the circle diameter CD of the jet nozzles 6.

To further improve the grinding ability, it is preferable to set the diameter d of the flat face 12 to about 0.1 to 1.0 times, in particular 0.3 to 1.0 times the inner diameter D of the barrel of the grinding chamber 1.

In the jet mill A1, the resin particles to be ground are continuously supplied through the upper supply port 13 of the grinding chamber 1 from the direction of the arrow S, falling through the chamber 1, and the particles are blown toward the injection point 5 by the jet stream of the compressed air jetted from the jet nozzles 6, and collided with each other to be ground. Then, most of the ground particles which collided and flied around the injection point 5 are crashed into the flat surface 12 with the jet stream from the jet nozzles 6 to be ground further. At this step, since the jet nozzles 6 are located in a position where excellent grinding efficiency can be achieved, the resin particles can be efficiently ground and the amount of finely ground resin particles is increased. The thus-ground resin particles are sucked through the exhaustion pipe 11 by the turning force of the rotor 10 into the powder cyclone.

As shown in FIG. 4, the jet mill A2 of the present invention has a frustum projection 20 on the bottom wall 3 of the grinding chamber 1, and the top face of the frustum projection corresponds to the flat surface 21. In the jet mill A2, the height H corresponding to the nozzle height from the jet nozzles 6 to the top flat surface 21 of the frustum projection 20, the diameter d corresponding to the diameter of the top flat surface 21 of the frustum projection 20 and other settings are the same as those of the jet mill A1.

A polygonal frustum or elliptical frustum may also be used instead of the circular cone frustum as long as a similar effect can be obtained. In that case, the diameter d of the top flat surface is designed to be the diameter of the circle inscribed in the top flat surface.

As shown in FIG. 5, the jet mill B is provided with a conical projection 30 on the bottom wall 3 of the grinding chamber 1 instead of the flat surface. The conical projection 30 is provided in order to promote further grinding of resin particles which have collided with each other and been ground at the injection point 5, and to increase the collision efficiency of the resin particles by facilitating the air flow within the grinding chamber and advancing the flow of the resin particles, as well as enabling the collection of the ground particles with greater ease.

It is preferable that the height H of the conical projection 30 is about 0.2 to 0.9 times, in particular about 0.4 to 0.5 times the distance between the injection point 5 and the bottom wall 3 from the viewpoint that the grinding efficiency is high. It is preferable that the apex angle θ of the conical projection 30 is about 30 to 150 degrees, in particular 60 to 120 degrees from the viewpoint that the flowability is excellent.

A polygonal cone or elliptical cone may also be used instead of the circular cone as long as a similar effect can be obtained.

When a jet mill with these novel structures are used, the air flow inside the grinding chamber 1 becomes smooth and the amount of resin particles (ground or not ground) adhering to or accumulated on the bottom wall can be reduced. This effect is more remarkably exhibited in the embodiments where a projection is provided on the bottom wall as in the jet mill A2 or the jet mill B.

The first process of preparing ground resin particles of the present invention is characterized by the use of the above novel jet mill.

The type of the resin particles to be ground is not particularly limited and fluorine resin particles or non-fluorine resin particles may be used, but the process of the present invention can be suitably used for the grinding of fluorine resin particles for which improvement of the properties of the ground resin particles and the grinding ability are required.

Examples of fluorine resin are perfluoro resins such as polytetrafluoroethylene (PTFE), tetrafluoroethylene-perfluoro(alkyl vinyl ether) copolymer (PFA) and tetrafluoroethylene-hexafluoropropylene copolymer (FEP); non-perfluoro resins such as ethylene-tetrafluoroethylene copolymer (ETFE), polyvinylidene fluoride (PVdF), polyvinylfluoride (PVF) and polychlorotrifluoroethylene (PCTFE). And the process of the present invention is most preferable for PTFE.

Examples of non-fluorine resin particles are polyolefins such as ultrahigh density polyethylene, polyesters, polyimides, aromatic polyesters and the like.

By supplying at least two kinds of resin particles simultaneously together with other additives such as a filler in some cases, homogeneous grinding, continuous and uniform mixing, and composite forming become possible. The resin particles to be combined may be both fluorine resin particles, but a combination of at least one fluorine resin particle and at least one non-fluorine resin particle is also possible. The mixing ratio is not particularly limited, and is to be decided in consideration of required properties.

Non-limiting examples of combination of resin particles are PTFE/aromatic polyester, PTFE/polyimide, PTFE/PFA, PTFE/FEP and the like. These are combinations for which continuous mixing and composite forming have been considered difficult.

In addition to at least one resin particles mentioned above, an inorganic filler may also be added. Examples of such inorganic fillers are carbon black, graphite, molybdenum disulfide and boron nitride. The mixing ratio of these fillers is not particularly limited.

When two or more resin particles are ground simultaneously, they may be mixed before supply or a plurality of supplying pipes 9 may be provided (FIG. 1).

As usual, the average particle size of the resin particles to be ground is about 100 to 5,000 μm, preferably 200 to 2,000 μm. According to the present invention, the particles are ground to 1/50 to 1/10 (about 4 to 200 μm), preferably 1/40 to 1/13 (about 5 to 150 μm) of the above average particle size.

The conditions of grinding, i.e. the conditions of operating the jet mill, are suitably selected in accordance with the type and particle size of the resin particles to be ground, the target particle size of the ground resin particles, the particle distribution, and the type and size of the jet mill to be used. For example, in the case of using the jet mill A1 and grinding fluorine resin particles (PTFE particles) having an average particle size of about 700 μm to obtain ground resin particles having an average particle size of about 30 μm, the following conditions can be presented.

Circle diameter CD/diameter of the barrel D: 0.80 to 1.0
Height H of injection point/circle diameter CD: 0.10 to 0.25
Pressure of grinding chamber: −0.2 MPa·G to +0.2 MPa·G
Temperature of grinding chamber: −10° C. to +30° C.
Jetting pressure of nozzle: 0.5 to 1.5 MPa·G
Supply of resin particles to be ground: 15 to 50 kg/hr In the process of the present invention, the ground resin particles are collected by using a classifying means as illustrated in FIG. 1. A typical classifying means is one in which a classifying rotor is disposed, and the resin particles of a certain particle size can be screened by changing the rotation number of the rotor.

The grinding ability in the present invention corresponds to the grinding speed (unit: kg/hr) usually applied in the jet mill method (jet mill). The grinding ability refers to how many kilograms of resin particles of a desired particle size can be collected per hour relative to a pre-determined amount of resin particles to be ground when two identically sized jet mills with identical collecting means are used.

According to the first process of the present invention, the grinding speed of the fluorine resin particles can be improved by 1.5 to 3.5 times as compared with a known method.

The second process of the present invention is explained below.

As mentioned above, it has been considered that the inside of the jet mill should be kept dry to maintain good flowability and the resin particles to be ground has been subjected to drying so that they are supplied to the mill in a dry state. Accordingly, a drying step and energy for drying are required.

Usually collision of resin particles results in generation of heat, but this heat is balanced out with endothermic action caused by adiabatic expansion when the compressed air is injected, and thus the temperature of the jet mill is hardly changed. This shows that when the temperature of the compressed air is not controlled, in other words when the compressed air of ambient temperature (room temperature) is supplied, the temperature of the jet mill does not fall below the ambient temperature (room temperature) under normal conditions.

In the meantime, as mentioned above, the higher the temperature, the larger the elasticity of the resin particles, and this makes it more difficult to carry out grinding. In addition, it is impossible to obtain ground particles of uniform particle size. For these reasons, the lower the temperature of the jet mill, the better. Thus, the compressed air and the jet mill have been cooled in order to lower their temperatures than the ambient temperature in spite of the disadvantage of high energy costs.

For example, when PTFE particles are ground without cooling the jet mill by jetting compressed air of room temperature (about 25° C.), the PTFE particles cause re-agglomeration or become fibrous when the temperature reaches or exceeds the glass transition temperature of the PTFE particles (about 19° C.). And this results in problems such that the average particle size of the ground particles to be collected is not uniform and that the apparent density is lowered.

Given this fact, attempts have been made to cool the compressed air (to about 0 to 20° C.) in consideration of the ambient temperature, providing a cooling jacket if necessary so that the grinding ability and the quality of the product are ensured without the influence of the ambient temperature. These remedies of course entail equipment and energy expenses.

The second process of the present invention makes it possible to omit these steps of cooling the jet mill and drying resin particles to be ground, which has been essential for known processes. The process also achieves predetermined average particle size and apparent density of resin particles even if compressed air of ambient temperature (room temperature) is applied, whereby the grinding ability is not reduced.

The second process of the present invention is characterized by water incorporated into the jet mill so that the temperature of the mill is lowered (or prevented from increasing) within the mill by means of the latent heat of vaporization.

That is, the second process of the present invention is a process for preparing ground resin particles by using a jet mill having a plurality of jet nozzles disposed at predetermined positions in a barrel of a grinding chamber toward the injection point located in the grinding chamber, the process comprising steps of: jetting compressed air toward the central axis of the grinding chamber through the jet nozzles disposed in the grinding chamber while resin particles to be ground are fluidized and continuously supplied from the top or the bottom of the grinding chamber, thereby colliding the resin particles to be ground with each other to grind the resin particles; and collecting ground resin particles of an intended particle size, wherein the resin particles to be ground are associated with water.

As a method of incorporating water into the jet mill, one where a feeding port of water (moisture) is disposed is also possible, but one where water is supplied together with the resin particles to be ground is more preferable.

This water supplying method is excellent in that the resin particles to be ground need not be dried previously contrary to conventional methods where such drying was essential.

In the second process, there is no problem if the temperature of the jet mill and the compressed air to be jetted is ambient temperature (room temperature, usually 5 to 50° C.). This means that it is not necessary to cool the inside of the jet mill or the compressed air to be jetted. However, in the case where the ambient temperature is too low, for example, below freezing point as in winter, dew condensation or freezing may occur inside the jet mill (phenomena of discharging the latent heat). Accordingly, there may be some cases where dried resin particles must be supplied as in the first process of the present invention, or the compressed air and the jet mill must be heated instead.

Other than jet mills A1, A2 and B, known jet mills may also be used in the second process. Known jet mills which do not have flat bottom wall or projection (frustum or cone) but a round bottom or conical hollow can be used.

However, in order to achieve the effect of the first invention more, it is desirable to use jet mill A1, A2 or B. More preferably, it is desirable to use jet mill A1 and A2. In the followings the second process is explained and jet mill A1 is used unless otherwise specified.

The resin particles to be ground which is supplied in the second process are associated with a certain amount of water. The amount of water to be associated with may be decided on an experimental basis depending on the kind of resins, the temperature of the compressed air to be jetted (ambient temperature), the temperature of the resin particles to be ground and water (ambient temperature) and the like.

The lower limit of the amount of water is one which is sufficient to bring the temperature of the jet mill lower than the ambient temperature with the latent heat of vaporization and at which the grinding of the resin particles is made easy, i.e., preferably higher than 0° C. to 30° C. at most, more preferably 5° to 25° C., most preferably 5° to 20° C.

The above temperature range of the jet mill is suitable for the grinding of resin particles which have a transition temperature in a temperature range of 0° to 50° C. Examples of such resin are PTFE (transition temperature: about 19° C. and about 30° C.) and FEP (transition temperature: about 19° C. and about 30° C.). Even in the case of resins such as PFA whose transition temperature and softening temperature is out of the ambient temperature range (PFA's transition temperature: about −100° C., −30° C. and +90° C.), the lower the temperature, the lower the elasticity, as mentioned above.

Thus, it is more efficient to carry out grinding at a temperature lower than the ambient temperature within the above temperature range.

Since associated water does not make the temperature of the jet mill higher than a desired temperature with the latent heat of vaporization, a large amount of water may be associated. However, water remains in the mill and the ground resin particle powder in a relatively large amount, which necessitates cleaning of the mill and drying of the particles. Thus, it is preferable to decide the upper limit.

A preferable upper limit of the associated water is different depending on the type of resin particles, intended use and temperature of the compressed air (ambient temperature). The upper limit is such an amount that the water content in the collected resin powder is controlled to at most 0.03% by weight, preferably at most 0.02% by weight, more preferably at most 0.01% by weight, an amount which does not require drying of the collected ground resin particle powder.

The amount of the associated water is 0.5 to 30 parts by weight, preferably 1 to 15 parts by weight, more preferably 3 to 10 parts by weight (based on 100 parts by weight of resin particles to be ground, the same applies below) when the temperatures of the resin particles to be ground, water to be supplied and the compressed air to be supplied are the ambient temperature (about 5 to 50° C.), though the amount depends on the type of resin particles and the like.

The method of associating water with the resin particles is quite simple. That is, a resin is prepared according to suspension polymerization, the obtained polymerization reaction solution (so-called "suspension after polymerization") which contains resin particles is washed with water, and the washed substance is used as it is or after drying, for example, being allowed to stand in the air if necessary. In case of PTFE, the amount of associated water after washing and dehydration is usually 10 to 30 parts by weight, and the obtained substance can be used in the second process of the present invention as it is without additional drying. Accordingly, a step for previous drying of the resin particles to be ground is not necessary. It is also possible to add water to the dried resin particles.

The temperature of the compressed air jetted in grinding may be the ambient temperature, and it is such a temperature that the temperature of the jet mill is brought to the above range with the latent heat of vaporization of the associated water. The temperature of the compressed air is usually 5 to 50° C., preferably 15 to 40° C. Drying is not particularly needed and this is advantageous in view of energy saving and simplifying the production process.

Furthermore, no particular cooling device such as a cooling jacket is necessary for the jet mill. However, such device may be provided for emergency situations such as sudden temperature increase or extremely high ambient temperature.

Other grinding conditions, including operating conditions of the novel jet mill of the present invention, are the same as that of the first process. The resin to be ground is also the same as that of the first process.

According to the second process of the present invention, cooling energy required for grinding can be remarkably reduced. in addition, since the drying step is not needed, energy costs can be reduced in this respect as well.

The ground resin particles obtained according to the second process have a uniform average particle size and a large apparent density regardless of the temperature of the compressed air, and the water content of the obtained particle powder can be kept low.

The present invention is then explained by means of examples using jet mill A1 (FIGS. 1 to 3 ), but is not limited thereto. The same effect can be obtained when jet mill A2 or B is used.

EXAMPLES 1 to 4 and COMPARATIVE EXAMPLE 1

Jet mill type 201/1 with fluidized bed (equipped with device for cooling compressed air) made by Hosokawa Micron Co., Ltd. was made ready and the bottom wall of the grinding chamber was flattened as shown in FIG. 2. Then four levels of the circle diameter of the jet nozzles, i.e., 132 mm, 153 mm, 212 mm and 250 mm were selected, while three levels the height of the injection point, i.e., 25 mm, 50 mm and 75 mm were selected. A dried powder of fluorine resin (PTFE) (water content: 0.01% by weight) was used as a raw material, and the relationship between the nozzle distance of jet nozzles and the height, which influences the grinding ability was examined under the grinding conditions shown in Table 1. The temperature of the jet mill was maintained to 20 to 22° C. by supplying cooled compressed air (18° C.). The rotation number of the classifying rotor for collection was set to 2,000 rpm. The results are shown in Table 2 and FIG. 6. Experiment was also carried out without modifying the jet mill, i.e., without the change of the circle diameter or the bottom wall (Comparative Example 1).

TABLE 1

| Grinding condition | |
|---|---|
| Diameter of barrel (inner diameter) (mm) | 250 |
| Air pressure (MPa) | 0.88 |
| Supplied amount of material (kg/hr) | 26 |
| Average particle diameter of material (μm) | 700 |

TABLE 2

| | Height of injection point (mm) | Ex. 1 Circle diameter (mm) 132 | Ex. 2 153 | Ex. 3 212 | Ex. 4 250 | Height of injection point (mm) | Com. Ex. 1 Circle diameter (mm) 200 |
|---|---|---|---|---|---|---|---|
| Grinding ability (kg/hr) | 25 | 9.4 | — | 25.4 | 23.3 | 195 | 7.1 |
| | 50 | 14.8 | 19 | 25.1 | 23.8 | | |
| | 75 | 15.3 | 20.9 | 24.7 | — | | |
| Average particle size (μm) | 25 | 35 | 26.9 | 25.5 | 29 | 195 | 29.2 |
| | 50 | 34 | 27.2 | 27.7 | 29.1 | | |
| | 75 | 36 | 29.6 | 27.9 | — | | |

As shown in Table 2 and FIG. 6, when the circle diameter is set larger in the order of 132 mm, 153 mm and 212 mm based on a fixed height of the injection point, the grinding ability (grinding speed) tends to increase, but when the circle diameter exceeds 212 mm, the grinding ability tends to decrease. As shown in Example 3, the highest grinding ability is achieved when the circle diameter is set to 212 mm and the height of the injection point is set to 25 mm.

EXAMPLES 5 to 9

In order to confirm whether the height of the injection point influences the flowability of the powder, PTFE dried powder (water content: 0.01% by weight) was ground according to the grinding condition shown in Table 3, and the relationship between the nozzle distance of jet nozzles and the height, which influences the grinding ability was examined. The compressed air was cooled to 5.5° C. and supplied to maintain the jet mill to 6.0 to 9.0° C. The rotation number of the classifying rotor for collection was set to 1,200 rpm. The results are shown in Table 4 and FIG. 7.

TABLE 3

| Grinding condition | |
|---|---|
| Diameter of barrel (inner diameter) (mm) | 440 |
| Air pressure (MPa) | 0.9 |
| Supplied amount of material (kg/hr) | 350 |
| Average particle diameter of material (μm) | 700 |

TABLE 4

| | Height of injection point | Ex. 5 | Ex. 6 | Ex. 7 | Ex. 8 | Ex. 9 |
|---|---|---|---|---|---|---|
| | | Circle diameter (mm) | | | | |
| | (mm) | 300 | 350 | 372 | 400 | 400 |
| Grinding ability (kg/hr) | 90 | 234.8 | 295.6 | 291.6 | 311.2 | — |
| | 58 | — | — | — | — | 346.2 |

Table 4 and FIG. 7 show that the larger the circle diameter, the larger the grinding ability (grinding speed) similarly to Examples 1 to 3. As shown in Example 9, the grinding ability is improved when the height of the injection point is adjusted low while maintaining the circle diameter as it is.

Accordingly, the grinding ability can be enhanced by optimizing the circle diameter and the height of the injection point.

Examples 1 to 4 and Comparative Example 1 show that when the circle diameter is smaller than 0.7 D, the bottom wall is flat and a certain height of the injection point is set (Examples 1 and 2), the grinding ability is improved as compared with the standard case of Comparative Example 1, but the improvement is not satisfactory. When the circle diameter is larger than 0.7 D, the bottom wall is flat and a certain height of the injection point is set, the grinding ability is improved by 3.5 times at the maximum.

EXAMPLE 10

PTFE resin particles (average particle size: 700 μm) after suspension polymerization which were associated with 6% by weight of water (water: PTFE=6:94) were supplied as PTFE resin particles in Example 1, at a speed of 25.5 kg/hr. On the other hand, the compressed air was injected to the mill at 17.5° C. under a pressure of 0.92 MPa. The cooling of the jet mill was not carried out. As a result, the inside temperature of the mill was maintained at 5.7° C.

The collected ground PTFE powder had an average diameter of 17.9 μm, an apparent density of 0.26 g/cm$^3$ and a water content of 0.07% by weight. The grinding efficiency was 34.0 kg/hr.

EXAMPLES 11 to 13

The grinding of water-containing PTFE powder (water content: 6% by weight) was carried out in the same manner as in Example 10 except that the temperature of the compressed air was changed to 20.9° C. (Example 11), 32.2° C. (Example 12) and 42.0° C. (Example 13). The results are shown in Table 5.

TABLE 5

| | Ex. 10 | Ex. 11 | Ex. 12 | Ex. 13 |
|---|---|---|---|---|
| Temperature of compressed air supplied (° C.) | 17.5 | 20.9 | 32.2 | 42.0 |
| Temperature to be maintained in jet mill (° C.) | 5.7 | 9.8 | 17.1 | 22.7 |
| Grinding ability (kg/hr) | 34.0 | 34.5 | 32.0 | 32.4 |
| Properties of collected ground resin particle | | | | |
| Average particle size (μm) | 17.9 | 16.7 | 17.5 | 17.8 |
| Apparent density (g/cm$^3$) | 0.26 | 0.27 | 0.26 | 0.27 |
| Water content (% by weight) | 0.070 | 0.073 | 0.005 | 0.004 |

Table 5 shows that when water is associated with the resin particles to be ground, the temperature inside the jet mill can be remarkably lowered and cooling of the jet mill is not needed. In addition, even if the temperature of the compressed air changes within the ambient temperature range, the average particle size or apparent density of the ground resin particles to be collected are not influenced, and thus the temperature control such as cooling of the compressed air becomes unnecessary. Moreover, when the compressed air is supplied at a relatively high ambient temperature, the water content of the collected ground resin particle powder can be remarkably reduced and additional drying is not required.

INDUSTRIAL APPLICABILITY

According to the present invention, by using, as a jet mill, a device with a novel structure (i.e., with a flat bottom wall or a conical projection having a pre-determined circle diameter of the jet nozzles in the grinding chamber), grinding of fluorine resin particles, for which the improvement of the grinding ability was difficult, can be carried out efficiently and uniform ground resin particles can be obtained while the jet mill is prevented from getting dirty.

In addition, by associating water with the resin particles to be ground, the temperature of the jet mill can be lower than the temperature of the material or the compressed air to be supplied, and cooling becomes unnecessary even if the jet mill is operated at ambient temperature. And since the drying of the resin particles to be ground is not needed, the pretreatments can be simplified. Further, the properties of the ground resin particles are not lost.

The invention claimed is:

1. A process for preparing ground resin particles by using a jet mill having a plurality of jet nozzles disposed at predetermined positions in a barrel of a grinding chamber toward the injection point located in the grinding chamber, and a bottom wall having a flat surface in part or in whole, parallel to the jet nozzles, the process comprising steps of:

jetting compressed air toward the central axis of the grinding chamber through the jet nozzles disposed in the grinding chamber while resin particles consisting essentially of polytetrafluoroethylene to be ground are fluidized and continuously supplied from the top or the bottom of the grinding chamber, thereby colliding the resin particles to be ground with each other to grind the resin particles; and collecting ground resin particles having an intended particle size.

2. The process of claim 1, wherein the tip of each jet nozzle is positioned so that the diameter of a circle contouring the tips of the jet nozzles is about 0.5 to 1.0 times the inner diameter of the barrel of the grinding chamber.

3. The process of claim 1, wherein the height from the injection point to the flat surface is about 0.1 to 0.4 times the diameter of a circle contouring the tips of the jet nozzles.

4. The process of claim 1, wherein the flat surface of the bottom wall is the top of a frustum provided on the bottom wall.

5. A process for preparing ground resin particles by using a jet mill having a plurality of jet nozzles disposed at predetermined positions in a barrel of a grinding chamber toward the injection point located in the grinding chamber, and a bottom wall having a conical projection immediately below the injection point the process comprising steps of:

jetting compressed air toward the central axis of the grinding chamber through the jet nozzles disposed in the grinding chamber while resin particles consisting essentially of polytetrafluoroethylene to be ground are fluidized and continuously supplied from the top or the bottom of the grinding chamber, thereby colliding the resin particles to be ground with each other to grind the resin particles; and collecting ground resin particles having a desired particle size, wherein the resin particles to be ground are associated with water and consist essentially of polytetrafluoroethylene resin particles.

6. The process of claim 5, wherein the height of the conical projection is adjusted to about 0.2 to 0.9 times the distance between the injection point and the bottom wall.

7. The process of claim 5, wherein the apex angle of the conical projection is adjusted to about 30 to 150 degrees.

* * * * *